US009816347B2

(12) United States Patent
Chenault et al.

(10) Patent No.: US 9,816,347 B2
(45) Date of Patent: Nov. 14, 2017

(54) NON-METALLIC SLIP ASSEMBLY AND RELATED METHODS

(71) Applicant: Wireline Solutions, LLC, Argyle, TX (US)

(72) Inventors: Louis W. Chenault, Argyle, TX (US); Graham L. Chenault, Argyle, TX (US); Glen Holcomb, New Iberia, LA (US); Kenneth W. Stokley, Victoria, TX (US)

(73) Assignee: FORUM US, INC., Houston, TX (US)

( * ) Notice: Subject to any disclaimer, the term of this patent is extended or adjusted under 35 U.S.C. 154(b) by 279 days.

(21) Appl. No.: 14/642,927

(22) Filed: Mar. 10, 2015

(65) Prior Publication Data

US 2015/0176366 A1 Jun. 25, 2015

Related U.S. Application Data

(63) Continuation of application No. 13/302,745, filed on Nov. 22, 2011, now Pat. No. 8,991,485, which is a continuation of application No. 61/416,617, filed on Nov. 23, 2010.

(51) Int. Cl.

| | |
|---|---|
| ***E21B 33/129*** | (2006.01) |
| ***E21B 33/12*** | (2006.01) |
| ***E21B 33/134*** | (2006.01) |

(52) U.S. Cl.

CPC ..... *E21B 33/1293* (2013.01); *E21B 33/1204* (2013.01); *E21B 33/1292* (2013.01); *E21B 33/1294* (2013.01); *E21B 33/134* (2013.01); *Y10T 29/49826* (2015.01)

(58) Field of Classification Search

CPC ..... E21B 33/129; E21B 33/1292; E21B 33/1293; E21B 33/1265

See application file for complete search history.

(56) References Cited

U.S. PATENT DOCUMENTS

| | | | |
|---|---|---|---|
| 1,923,283 | A | 8/1933 | Stokes |
| 2,305,062 | A | 12/1942 | Church et al. |
| 2,331,532 | A | 10/1943 | Bassinger |
| 2,647,584 | A | 8/1953 | Baker et al. |
| 2,652,894 | A | 9/1953 | Brown et al. |
| 2,691,418 | A | 10/1954 | Connolly |
| 3,091,293 | A | 5/1963 | Fry |
| 3,181,614 | A | 5/1965 | Brown |
| 3,190,359 | A | 6/1965 | Brown |

(Continued)

OTHER PUBLICATIONS

Technology Applications; JPT; Apr. 1999; 2 pages.

(Continued)

*Primary Examiner* — Giovanna C Wright

(74) *Attorney, Agent, or Firm* — Patterson & Sheridan, L.L.P.

(57) ABSTRACT

A downhole isolation tool includes a mandrel made of non-metallic material, the mandrel comprising an isolation region at a first end of the mandrel, a shear sleeve adapter disposable on an outer surface of the isolation region, the shear sleeve adapter having holes aligned with holes in the outer surface of the isolation region, a slip assembly positioned around an outer surface of the mandrel, a packing element positioned around the outer surface of the mandrel, and a shoe positioned around the outer surface of the mandrel at a second end of the mandrel.

18 Claims, 4 Drawing Sheets

(56) References Cited

U.S. PATENT DOCUMENTS

| | | | |
|---|---|---|---|
| 3,298,440 | A | 1/1967 | Current |
| 3,306,362 | A | 2/1967 | Urbanosky |
| 3,371,716 | A | 3/1968 | Current |
| 3,554,280 | A | 1/1971 | Tucker |
| 3,602,305 | A | 8/1971 | Kisling, III |
| 3,910,348 | A | 10/1975 | Pitts |
| 4,151,875 | A | 5/1979 | Sullaway |
| 4,595,052 | A | 6/1986 | Kristiansen |
| 4,693,309 | A | 9/1987 | Caskey |
| 4,942,925 | A | 7/1990 | Themig |
| 5,311,939 | A | 5/1994 | Pringle et al. |
| 5,540,279 | A | 7/1996 | Branch et al. |
| 6,167,963 | B1 | 1/2001 | McMahan et al. |
| 6,796,376 | B2 | 9/2004 | Frazier |
| 7,000,705 | B2 | 2/2006 | Buyers et al. |
| 7,424,909 | B2 | 9/2008 | Roberts et al. |
| 7,475,736 | B2 | 1/2009 | Lehr et al. |
| 7,600,572 | B2 | 10/2009 | Slup et al. |
| 7,694,745 | B2 | 4/2010 | McGregor et al. |
| 7,740,079 | B2 | 6/2010 | Clayton et al. |
| 7,779,906 | B2 | 8/2010 | Porter et al. |
| 2007/0051521 | A1 | 3/2007 | Fike et al. |
| 2009/0038790 | A1* | 2/2009 | Barlow ..... E21B 33/129 166/89.2 |
| 2009/0044957 | A1* | 2/2009 | Clayton ..... E21B 33/134 166/387 |
| 2010/0155050 | A1 | 6/2010 | Frazier |
| 2010/0263876 | A1* | 10/2010 | Frazier ..... E21B 33/129 166/378 |

OTHER PUBLICATIONS

Python Composite Bridge Plug; BJ Services Company; Offshore Technology Carnival; PowerPoint Presentation; 2002; 21 total pages.

Python Composite Plugs Brochure; BJ Services Company; 2008; 4 total pages.

Composite Plugs Catalog; Magnum Oil Tools; Jan. 13, 2010; 24 total pages.

* cited by examiner

NON-METALLIC SLIP ASSEMBLY AND RELATED METHODS

CROSS-REFERENCE TO RELATED APPLICATIONS

This application is a continuation of U.S. patent application Ser. No. 13/302,745 filed on Nov. 22, 2011, entitled "NON-METALLIC SLIP ASSEMBLY AND RELATED METHODS" which claims priority to U.S. Provisional Patent Application Ser. No. 61/416,617 filed on Nov. 23, 2010, entitled "DOWN HOLE FRAC PLUG/BRIDGE PLUG", both applications are hereby incorporated by reference herein.

FIELD OF THE INVENTION

The present invention relates to slip assemblies for use with downhole tools used in both vertical and horizontal well bores and, more specifically, to a slip assembly constructed primarily of non-metallic material.

BACKGROUND

In recent years, hydraulic fracturing has become a significantly common and more cost efficient method of extracting natural gas from shales and tight formations. In the past, the downhole tools used have been constructed with a significant amount of metallic material such as aluminum or brass to construct a percentage of or all of the mandrel and other components. This construction requires significant drill time as metallic material is often difficult to drill. Accordingly, there is a need for downhole isolation tool construction that has the strength provided by metallic material, while using a smaller percentage of the metallic material.

Further, as non-metallic material has began to be utilized to construct downhole tools, there is a need for an downhole isolation tool that allows a user to alter the subassembly to form three or more different and separate configurations of the isolation tool without having to add metallic components such as brass, aluminum or other comparable metallic materials to the subassembly that would have to be drilled or milled from the wellbore.

Also, separate components have been needed to hold lower components of a tool in place and/or to provide a contact point for a setting component. Commonly referred to as a lock ring or load ring, this common downhole tool component has been utilized for many years. By eliminating the use of a lock ring, which typically contains metallic materials, there is less material to be drilled out from the well bore.

In addition, shear studs, shear rings, and/or shearable or partible mandrels have also been utilized throughout the industry to set downhole tools in the well bore. The use of shear studs would hamper any conversion of downhole tools due to the fact that these setting devices typically attach to a tool inside of a mandrel, meaning that any conversion would more than likely have to take place in the bottom of the tool. Bottom conversion would be unlikely or generally mean that the bottom tool component, commonly referred to as a shoe or lower guide, would have to be removed to make the conversion. Bottom conversion would also have a negative effect on how the zones isolate during drillout. The use of shearable or partible mandrels mean that the actual downhole tool separates, parts and/or actually breaks in two pieces.

Therefore, there is a need for a composite downhole isolation tool that can be easily converted from one configuration to another in a matter of minutes while in the field without having to add metallic components to the subassembly that would have to drilled or milled from the wellbore. There is also a need to be able to set a tool utilizing simpler and more cost efficient methods that do not require the use of shear studs, setting rods, shear rings, or partible or shearable mandrels. Such a tool would allow a user to purchase one down hole tool, easily and cheaply convert it into at least three different configurations, and set it in the wellbore using a more reliable and cost-efficient method. Accordingly, an invention that provides a downhole isolation tool that can be converted without adding metallic components or removing any subassembly components and can be set simply and economically, will lower the overall costs of hydraulic fracturing and have an important and positive impact in the industry.

SUMMARY OF THE INVENTION

According, the present invention addresses the foregoing needs in the prior art. In one exemplary embodiment, the present disclosure provides a general subassembly downhole drillable isolation tool comprising a non-metallic mandrel, a non-metallic and stationary slip stop, a plurality of petal backup rings adjacent to the sealing elements, a lower and upper slip assembly, a sealing element or a series of sealing elements disposed around the sealing surface of the mandrel, a bonded or threaded lower guide shoe, a means to modify flow thru the mandrel, and anti-rotation features on the mandrel and lower guide shoe.

The general subassembly, which can be a ball drop plug in one exemplary embodiment, houses a mandrel completely constructed from non-metallic material. This mandrel has internal features which, when combined with non-metallic conversion accessories, can be easily transformed into a caged ball plug or a bridge plug.

In one exemplary embodiment, the present disclosure utilizes composite materials along with anti-rotation features, such as lugs, to effectively reduce drill time while maintaining the integrity and durability of the downhole tool disclosed. Prior art designs, such as shearable or partible mandrels, fail to guarantee that the components would lock into place due to the different ways in which a mandrel may part.

In another exemplary embodiment, the invention comprises a plurality of seals, at least one slip comprised with a percentage of non-metallic material, a bottom guide shoe with anti-rotation features, and a method for housing a pump down assembly, and a setting assembly. The setting assembly includes a shear sleeve adapter with an improved shear device that allows a drop ball frac sealer to be run in place inside the shear adapter on top of the isolation tool. The shear sleeve adapter may have at least one drilled and tapped hole for shearing devices. In another embodiment, the sheer sleeve adapter has at least one drilled hole for fluid bypass. The shear sleeve adapter may connect to a wireline, hydraulic or other compatible setting tool.

A drillable downhole isolation tool according to a further exemplary embodiment of the present disclosure is comprised of a mandrel having threads on the outside diameter of lower portion and having an upper portion that connects to a shear sleeve adapter using at least one shearing device. According to exemplary embodiments of the present disclosure, the shearing device may be a pin with a specified shear value. The shearing device may be housed in the upper portion of the mandrel using holes.

In yet another embodiment of the present disclosure, a drillable downhole isolation tool may comprise a mandrel including threads in the inside diameter of the upper portion and shearing devices on the outside diameter of the upper portion. The upper portion of the mandrel may also house a caged ball adapter and a bridge plug adapter, as well as a smaller outside diameter on its upper most portion. This smaller outside diameter allows, for example, a downhole isolation tool manufactured to be set in 5½" casing to be set off of a Baker Hughes™ #10 or comparable setting tool.

A drillable downhole isolation tool according to embodiments of the present disclosure may comprise a non-metallic mandrel consisting of an upper, middle and lower portion, an upper slip assembly on the middle portion of the mandrel, and a lower slip assembly on the middle portion of the mandrel. The upper and lower slip assemblies may comprise a percentage of non-metallic material, although it should be appreciated that the slips may be formed from a metallic material without departing from the objects of the present disclosure. These slips also may include ridges or hardened wickers. It also should be appreciated that the upper and lower slip assemblies may be entirely formed from non-metallic material.

A drillable downhole isolation tool according to embodiments of the present disclosure may also comprise a mandrel consisting of an upper, middle and lower portion, a lower guide shoe on the lower portion of the mandrel, and a pump down assembly. The lower guide shoe is formed from non-metallic material and is attached to the lower portion of the mandrel using threads. The lower guide shoe includes anti-rotation lugs that engage with similar lugs on the upper portion of the mandrel of a previously set tool. The lower guide shoe has a slot on the outside diameter for connecting to a pump down assembly as well as a specified inner diameter large enough to encase a dropped ball on a previously set tool.

The foregoing has outlined rather broadly the features and technical advantages of the present disclosure in order that the detailed description that follows may be better understood. Additional features and advantages will be described hereinafter which form the subject of the claims of the disclosure. It should be appreciated by those ordinarily skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF DRAWINGS

An exemplary embodiment of the present invention will now be described, by reference to the accompanying drawings, in which.

DETAILED DESCRIPTION OF THE INVENTION

Illustrative embodiments and related methodologies of the invention are described below as they might be employed to provide a convertible downhole isolation plug. In the interest of clarity, not all features of an actual implementation are described in this specification. It will of course be appreciated that in the development of any such actual embodiment, numerous implementation specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Exemplary embodiments of the present disclosure described herein provide a predominantly non-metallic downhole isolation tool that is field convertible to at least the following configurations: a bridge plug, a ball drop plug, or a caged ball plug. The components used to assemble the isolation tool are primarily manufactured from non-metallic material, although some components will be comprised of a percentage of metal. In specific exemplary embodiments, the frame, which is the mandrel of the isolation tool on which the outer components are placed, is comprised entirely of non-metallic material (for example, composite material), as are the conversion accessories (i.e., the bridge, ball drop, and caged ball adapters and accessories). The composite material discussed herein may be, for example, a high performance epoxy resin matrix with reinforced glass fibers, or phenolic with chopped fibers. The term "non-metallic" as used herein refers to materials other than steel, metal, aluminum, brass, iron, or similar materials as traditionally used in downhole isolation tools.

As will be described below, the inner diameter threads in the upper portion of the mandrel (also referred to herein as the "isolation region"), along with optional accessories, allow a user to easily convert the isolation tool to either a bridge plug, ball drop plug, or caged ball plug without having to have three different tools on location, change vital components, setting accessories and/or techniques, or add any metallic components to the subassembly that would have to be drilled or milled from the wellbore.

Figure 1A:
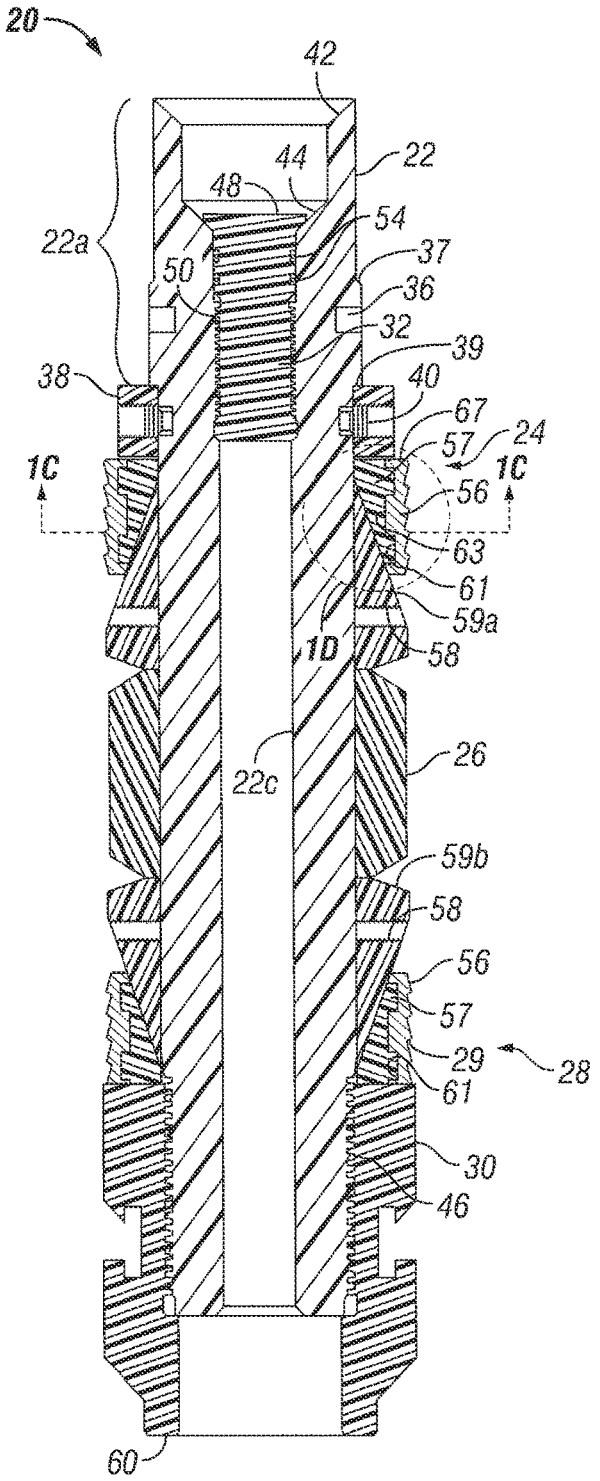
FIG. 1A illustrates a bridge plug according to an exemplary embodiment of the present invention.

FIG. 1A illustrates a bridge plug 20 according to an exemplary embodiment of the present invention. Bridge plug 20 comprises a mandrel 22, an upper slip assembly 24, packing element 26, lower slip assembly 28, and shoe 30 threaded onto the lower end of mandrel 22. At the upper end of mandrel 22, a threaded connection 32, is provided whereby a bridge plug adapter 48 can be screwed into threaded connected 32 along the inside diameter of mandrel 22, thus blocking flow through the mandrel. By adding the bridge plug adapter 48, a user can easily convert tool 20 from, for example, a ball drop plug into a bridge plug.

In this exemplary embodiment, mandrel 22 is formed from a non-metallic or composite material that may be incorporated into a tool such as the bridge plug depicted in FIG. 1A. The upper end of mandrel 22 includes a shoulder 39 formed by a specified larger outer diameter, section 22*a* (isolation region), which prevents mandrel 22 from being forced out of the bottom of the lower plug components when pressure is applied from above. The larger diameter of section 22*a* eliminates the need for a specific separate component that holds the lower components in place and/or provides a contact point for a setting sleeve (as required in prior art plugs). This larger outer diameter also eliminates the need for a lock ring, as also utilized in prior art plugs.

In addition, the outer diameter of mandrel 22 includes a smaller outside diameter on its upper most portion delineated by a shoulder 37. In this exemplary embodiment, the smaller outside diameter allows, for example, plug 22 to be set in 5½" casing to be set off of a Baker Hughes™ #10 or comparable setting tool. Moreover, although not illustrated, at the top of section 22*a*, one or more lugs 34 can be placed which engage with the shoe of a higher bridge plug to prevent spinning of the bridge plug during drill out, as would be understood by one ordinarily skilled in the art having the benefit of this disclosure.

Section 22*a* further includes a plurality of holes 36 spaced there-around which connect to a shear sleeve adapter 100 (FIG. 1B) using shear screws or pins as understood in the art. Such a design allows shear sleeve adapter 100 to shear the screws and separate from section 22*a* at an appropriate setting force, as would be readily understood by one ordinarily skilled in the art having the benefit of this disclosure. Moreover, the use of holes 36 eliminates the need for a shear stud, shear ring, setting rod, or shearable mandrel (as utilized in prior art plugs) and leaves the inner bore 22*c* of the mandrel 22 open so that bridge plug 20 can be reconfigured. Because there are no threads on plug 20 that connect to a setting device, plug 20 of the present invention can be set on any setting tool based only on the shear sleeve adapter 100.

Figure 1B:
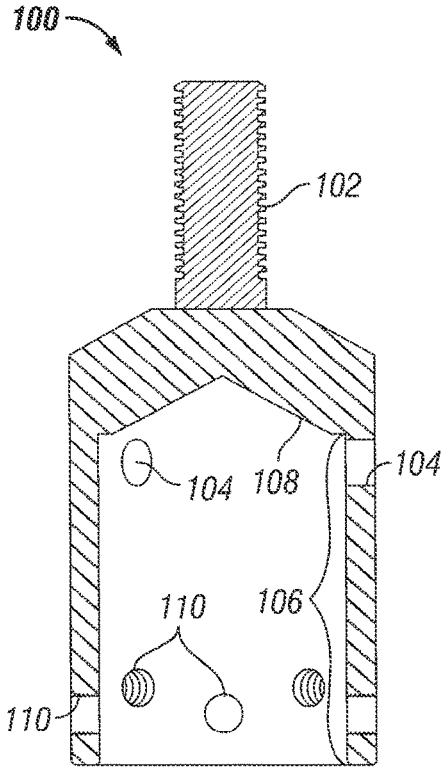
FIG. 1B illustrates an outside shear adapter according to an exemplary embodiment of the present invention.

Referring to the exemplary embodiment of FIG. 1B, adapter 100 has a specified pin thread 102 on the top that makes up to the appropriate setting tool. It also includes flow holes 104 drilled in the top portion of outside shear adapter 100. This allows fluid to bypass all the way through an open inner diameter of the tool through the top of the shear adapter 100. A plurality of pin holes 110 are spaced around adapter 100 in which shear pins/screws connect through to holes 36 on mandrel 22 during the setting process. In this exemplary embodiment, holes 110 may be comprised of two rows of 4 holes at 90 degrees apart, the rows being staggered at 45 degrees apart—for a total of 8 holes 110. Shear sleeve adapter 100 also has a specified extended inner diameter height 106 that allows a user to run a drop ball in place on the top bevel 108 while inside shear adapter 100.

Shear adapter 100 eliminates the need for a shear stud, shear ring, setting rod, or shearable mandrel. It also allows a tool to be set using multiple setting tools. Multiple shear adapters 100 can be used depending on which setting tool is used. Due to the fact that no threads on the actual frac plug make up directly to a setting tool, the user is not limited in using only one setting tool; the user can simply change shear adapter 100. The extended height 106 of the shear adapter allows a user to run a drop ball in place rather than dropping the same ball from the surface after the plug has been set.

Referring again to FIG. 1A, mandrel 22 also has a hollow bore 22*c* extending all the way through mandrel 22, thus allowing pressure to equalize after bridge plug adapter 48 (as will be described below) is drilled out during the drilling process. At the lower end of mandrel 22 are threads 46 which allow shoe 30 to connect to the lower portion of mandrel 22, so that the desired setting and/or well pressure will not separate shoe 30 from the connecting portion of mandrel 22. Prior art composite plugs utilize pins, rods, or screws to prevent the shoe from being forced from the mandrel when the plug is set. However, in this embodiment of the present invention, threads 46 are strong enough, due to the strength of the composite material forming mandrel 22, to keep shoe 30 in place without the use of pins, rods, or screws.

Further referring to the exemplary embodiment of FIG. 1 A, section 22*a* of mandrel 22 includes an upper beveled edge 42 and a lower beveled ball seat 44 in the inside diameter of section 22*a*. The inner diameter of mandrel 22*a* acts as a sealing surface so that o-rings and/or packing can seal on the inner diameter and hold pressure, as understood in the art. However, unlike the prior art, the present invention allows this sealing to be accomplished without having to utilize a metallic material, such as brass or aluminum, in mandrel 22 to create a sealing surface. A valve (not shown) may be disposed within mandrel 22 to manipulate flow through plug 20, thus allowing mandrel 22 to be closed, partially open or completely open to restrict, allow, or block flow within bridge plug 20, as would be readily understood by one ordinarily skilled in the art having the benefit of this disclosure.

As previously stated, the composite material used to form mandrel 22 is designed such that threads 46 are strong enough to eliminate the need for pins or screws to reinforce the connection between mandrel 22 and shoe 30 (i.e., threads 46). As previously stated, the composite material may be, for example, a high performance epoxy resin matrix with reinforced glass fibers. However, those ordinarily skilled in the art having the benefit of this disclosure realize that a variety of other non-metallic materials may be substituted for this composite material.

Referring to the exemplary embodiment of FIG. 1A, threads 32 along the inner diameter of section 22*a* allow mandrel 22 to be converted from a full open inner diameter plug to a solid inner diameter plug (i.e., bridge plug). This is accomplished using bridge plug adapter 48 which has threads 50 on its lower end that mate with threads 32. Bridge plug adapter 48 is also made from a non-metallic or composite material such as a high performance epoxy resin matrix with reinforced glass fibers as previously described, and comprises threads 50 on its lower end with two O-rings 54 above. In this embodiment, adapter 48 has a screwdriver slot (not shown) on its top which allows one to thread it down into threads 32 until the larger OD portion of the adapter 48 bottoms out on the ball seat 44. At the same time, O-rings 54 of adapter 48 are forced down inside the sealing portion of the mandrel 22 and create a seal.

After insertion of bridge plug adapter 48, bridge plug 20 now has a solid inner diameter, which thus blocks flow and/or pressure from moving entirely through plug 20 from above or below. The strength of the composite material utilized in bridge plug adapter 48 and mandrel 22 allow provide threads 32,50 with sufficient strength to withstand downhole pressures without the need for any additional metallic sleeves or other components. Accordingly, this solid inner diameter bridge plug 48 of the present invention allows the user to convert an isolation tool easily and in the field without changing vital components or removing the lower shoe guide.

Figure 1C:
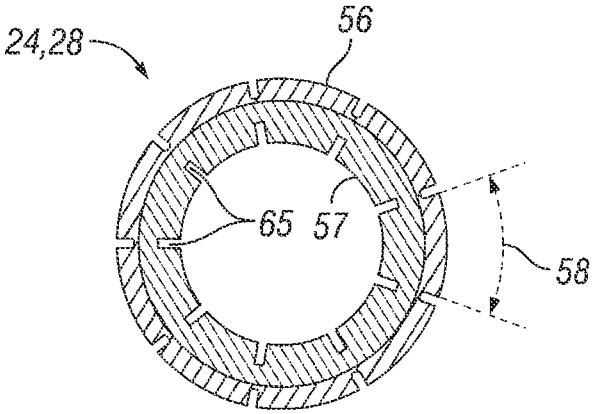
FIG. 1C is a sectional view of the slip assembly of FIG. 1A along line 1C.
Figure 1D:
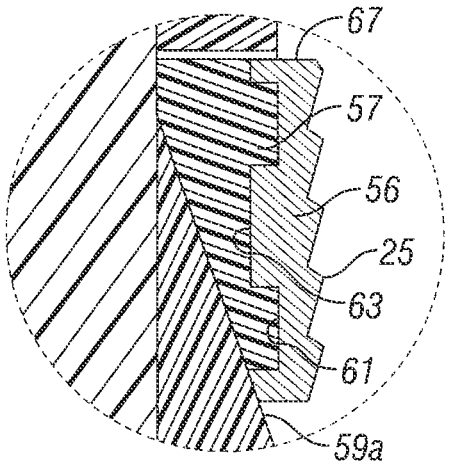
FIG. 1D is an exploded view of the upper slip assembly of FIG. 1A.

Referring to FIGS. 1A, 1C, and 1D exemplary embodiments of the present invention also provide a slip assembly comprising an upper slip assembly 24 (just below slip stop 38) and lower slip assembly 28. Slip stop 38 is coupled to mandrel 22 via screws 40. The slip assembly is made from a combination of easier drillable composite material that houses slip inserts 56, rather than relying on a traditional slip constructed from cast iron or carbide. Inserts 56, which are molded to the composite slip carrier 57, provide the gripping function of the slip, while the composite inner core serves as the carrier 57 for the inserts 56. The inner core, which is the composite slip carrier 57 of the assembly, is formed from a composite material, such as, for example, injected phenolic with chopped fibers. Inserts 56 may be comprised of steel or another suitable material, as understood in the art.

Slip carrier 57 is segmented into pads 58 to allow separation between slip inserts 56, thus allowing carrier 57 to segment and cause the slip inserts to grip the casing wall, as would be understood by one ordinarily skilled in the art having the benefit of this disclosure. Slip inserts 56 placed on the upper slip assembly 24 have upward facing ridges or heat treated hardened wickers 25 that, when forced down onto cone 59 with slip carrier 57, come in contact with and grip the conduit wall. These upward facing teeth 25 assist in the setting of the bridge plug 20 and hold plug 20 in place against well pressure. The slip inserts 56 placed on the lower slip carrier 57 have downward facing ridges or teeth 29 that, when forced up onto cone 59 with slip carrier 57, come in contact with and grip the conduit wall. These downward facing teeth 29 also assist in the setting of bridge plug 20 and hold plug 20 in place against well pressure. Slip inserts 56 are thinner than traditional cast iron slips (which utilize all metal), meaning less metallic material on the tool, but are designed along with the slip carriers to provide the durability and strength of a full metal slip. The present invention, utilizing a composite carrier 57, instead of a traditional full cast iron slip, can eliminate 60-70% of the metallic material traditionally utilized to construct a cast iron slip. Elimination of such a high percentage of metallic material from a downhole tool and replacing such material with the easier drillable composite material described herein calculates to less drill time when the tool is to be removed from the wellbore.

Further referring to FIGS. 1A and 1D, the inner diameter of slip inserts 56 comprise one or more circumferential grooves 61 that catch and work in conjunction with mating grooves 63 on the outer diameter of slip carriers 57. A two-part epoxy glue or equivalent is also utilized to bond slip inserts 56 to carriers 57. In this exemplary embodiment, grooves 61,63 are molded at 90.degree. angles; however, those ordinarily skilled in the art having the benefit of this disclosure realize other angles of lesser or greater value may be utilized.

Grooves 61,63 provide durability to the slip assembly by preventing the bonded or molded slip inserts 56 from being forced off of slip carrier 57 due to setting force or well pressure, and prevents relative movement between carrier 57 and slip inserts 56. Although the composite slip carriers 57 of the present invention eliminate the need for a full metal slip, the carriers 57 hold steel slip inserts 56 in place, thus providing the strength of a full metal slip, with a small percentage of actual steel or cast material.

In this exemplary embodiment, the upper and lower slip carriers 57, forming a slip carrier assembly, are constructed from a non-metallic material as previously described. Upper and lower slip carriers 57 are positioned on the middle portion of mandrel 22. Referring to FIG. 1C, the inner diameter of slip carrier 57 and the outer diameter of slip inserts 56 include appropriately spaced vertical slots 65 that allow the slip carrier 57 and inserts 56 to segment during the setting process, and to reduce the material used to form carrier 57. Accordingly, there is less material to be drilled out, thus reducing drill out time.

Upper slip assembly 24 has a specified outer diameter that allows a surface area for a setting sleeve. Upper slip assembly 24 includes a shoulder 67 to allow for point of contact with a setting sleeve. Shoulder 67 allows the setting sleeve to apply setting force directly onto the slip assembly 24, thus transferring the setting force to the slip inserts 56 and below components.

As described herein, upper and lower slip carriers 57 are formed from composite material as opposed to full metal. Replacing a traditional cast iron design with a composite is preferable in that composite is easier to drill than metal. Upper slip assembly 24 also provides a shoulder 67 for the setting sleeve, which eliminates the need for an upper component that has such a contact area.

As would be understood by one ordinarily skilled in the art having the benefit of this disclosure, the slip assemblies 24,28 may be substituted with a full metal segmented slip, should a composite slip assembly not be available or commercially feasible. According to embodiments of the present disclosure, the composite slip carrier 57 can eliminate 60-70% or more of the metal with composite material. In one exemplary embodiment described herein, the only portion of the composite slip assembly comprised of metal are the steel inserts 56 that are molded to slip carrier 57. This type of slip assembly allows the downhole tool to set and hold inside of the casing, while at the same time reducing this metallic material used therein and, thus, reducing drill-out time.

Still referring to the exemplary embodiment of FIG. 1A, an upper cone 59*a* and lower cone 59*b* is depicted that sits below the upper slip carrier 57 and above the lower slip carrier 57, respectively—jointly forming a cone assembly. The cone assembly guides and forces the slip carrier 57 to segment under setting force. Upper and lower cones 59*a/b* are formed from non-metallic material such as, for example, phenolic with chopped fibers, and are located on the middle portion of mandrel 22. Upper cone 59*a* is located adjacent to upper slip carrier 57. Upper cone 59*a* also has a tapered upper end, and lower cone 59*b* has a tapered upper end. Upper cone 59*a* tapers upward and inward towards mandrel 22, while the lower cone tapers downward and inward towards mandrel 22. Each cone 59*a/b* includes drilled and tapped holes 58 for screws that prevent relative movement of cones 59*a/b* before the setting process. The cones 59*a/b* allow and guide slip carriers 57 to be forced along the tapered surface of cones 59*a/b* so that slip inserts 56 will engage with the casing wall. The upper and lower cones 59*a/b* are attached to mandrel 22 using at least one shearing device such as, for example, a pin which is inserted into holes 58.

As previously described, FIG. 1A also depicts a lower shoe 30 that is threaded to the lower end of the mandrel 22 via threads 46. In this exemplary embodiment, lower shoe 30 is also formed from a non-metallic material such as, for example, a high performance epoxy resin matrix with reinforced glass fibers, and is located on the lower portion of mandrel 22. As the setting force is transferred down the tool 20, shoe 30 allows the components between itself and the setting sleeve to be compressed and/or extruded, allowing plug 20 to set inside the conduit. In this embodiment, shoe 30 includes one or more distinct lugs 60 that engage with lugs 34 on the top of the mandrel of a lower plug. This allows bridge plug 20 to engage with the upper portion of a lower plug to assist in the drill out. Those ordinarily skilled in the art having the benefit of this disclosure realize more or less lugs may be utilized as desired.

Figure 2:
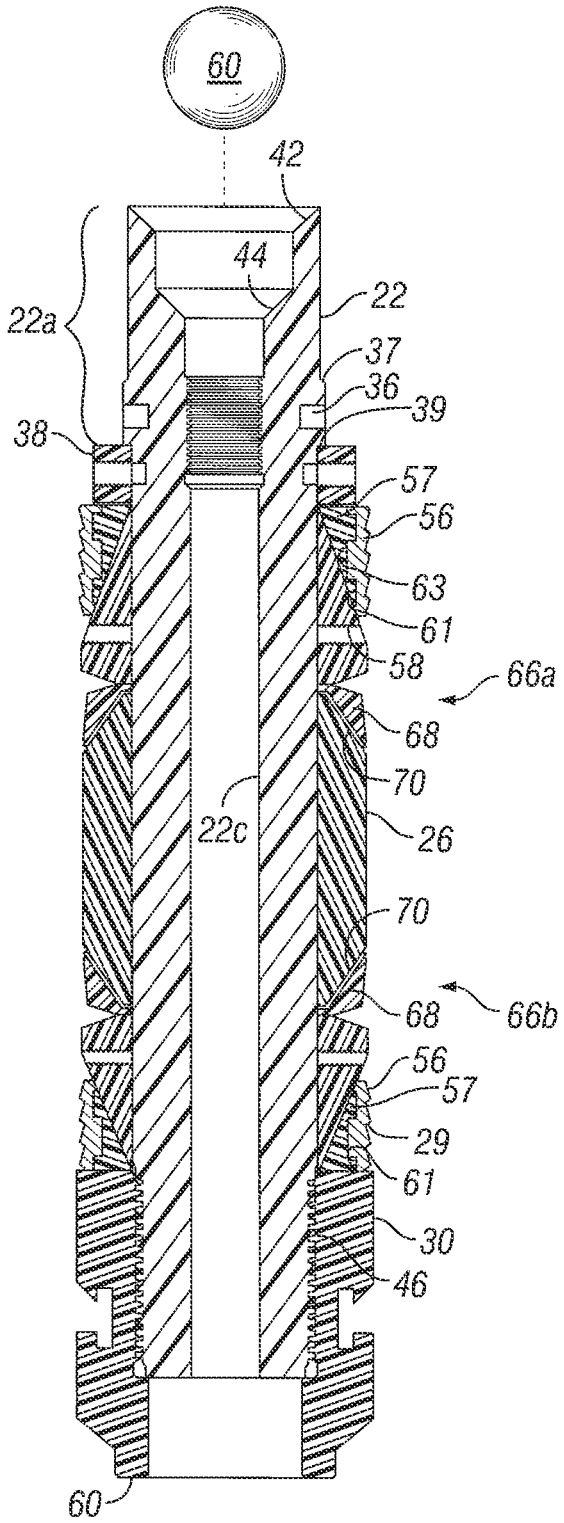
FIG. 2 illustrates a ball drop plug according to an exemplary embodiment of the present invention.

An alternative exemplary embodiment of the present invention is illustrated in FIG. 2. Here, the tool 20 of is identical to FIG. 1A, except that section 22*a* (isolation region), does not have bridge plug adapter 48 inserted inside it (bore 22*c* is open), and this embodiment includes a backup ring as will be briefly described below. Instead, in this embodiment, plug 20 is a ball drop plug. To construct ball drop plug 20, the hollow bore 22*c* of mandrel 22 is left unobstructed so that a ball 60 can sit on the lower beveled ball seat 44 of mandrel 22 after plug 20 is set. Ball 60 can be dropped from the surface, as traditionally done, or it may run inside shear adapter 100 (as previously described), which eliminates the need for the user to drop ball 60.

Further referring to FIG. 2, upper beveled edge 42 is provided to aid in allowing ball 60 to move down into mandrel 22 in horizontal applications. Beveled edge 42 is angled towards ball seat 44 in order to provide an angled surface, instead of a flat one, which allows ball 60 to roll onto seat 44. Therefore, the risk of ball 60 becoming wedged between the outer diameter of mandrel 22 and the casing is limited.

The exemplary embodiment of FIG. 2 also includes upper and lower backup rings 66*a/b* (forming a backup ring assembly 66) positioned at the upper and lower ends of packing element 26. An exploded view of the ring assembly is shown in FIG. 3B. Upper and lower backup rings 66*a/b* are formed from non-metallic material, such as described previously, with each backup ring having two separate non-metallic rings, an inner backup 68 and an outer backup 70. These rings have slots that allow the ring segments to "petal" out towards and to the conduit wall, thus preventing the packing element 26 from extruding past backup ring 66*a/b*. The slots on the inner backup 70 are spaced between the slots on the outer backup 68. Since backup rings 66*a/b* are made of composite material, drill out time is reduced as compared to traditional rings made of metallic material. Further, the material allows the petals of inner and outer backups 70,68 to bend with setting force and not break or snap. Although described in relation to the ball drop plug 20 of FIG. 2, those ordinarily skilled in the art having the benefit of this disclosure realize the backup ring assembly may be utilized with other embodiments described herein.

Figure 3A:
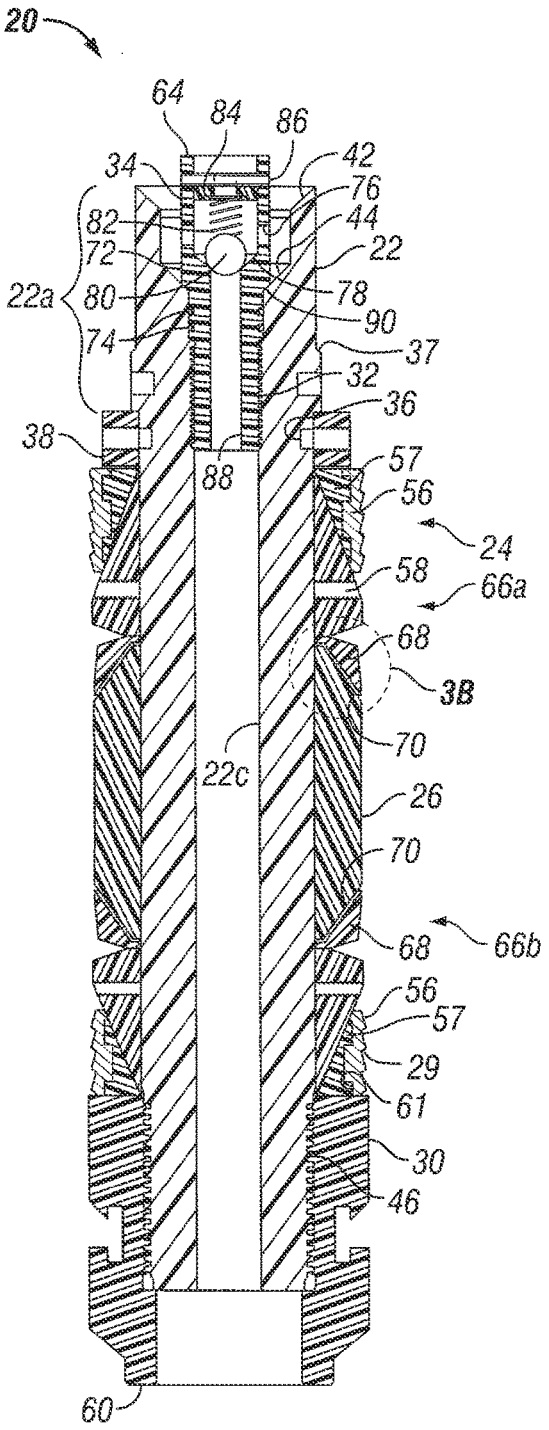
FIG. 3A illustrates a caged ball plug according to an exemplary embodiment of the present invention.
Figure 3B:
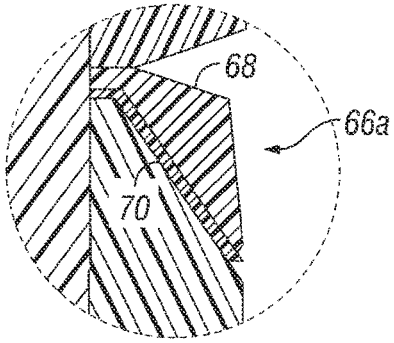
FIG. 3B illustrates an exploded view of the retainer ring of FIG. 3A.
Figure 3C:
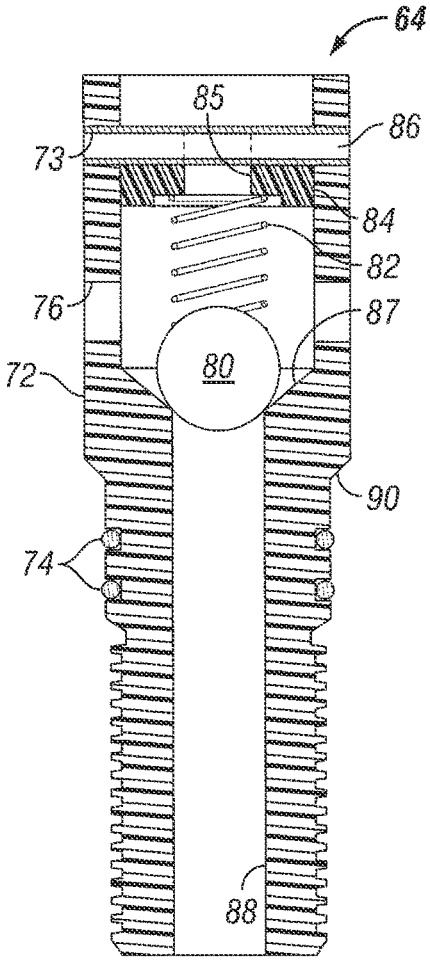
FIG. 3C illustrates an exploded view of the caged ball adapter of FIG. 3A.

FIG. 3A illustrates a caged ball plug according to an exemplary embodiment of the present invention. Tool 20 is again constructed as described in relation to FIG. 1A, except that caged ball adapter 64 is utilized in the isolation region. The mandrel 22 comprises a threaded connection 32 inside bore 22*c*, as previously described, which allows mandrel 22 to be converted from a bridge plug (FIG. 1A) or a drop ball plug (FIG. 2) to a caged ball plug (FIG. 3A). Also referring to FIG. 3C, caged ball adapter 64 includes a caged ball housing 72 which has mating threads to the threaded connection 32 inside mandrel 22, O Rings 74 above the mating threads on housing 72 for sealing pressure, and fluid bypass ports 76 above a ball seat 78. Additional items as illustrated are the ball 80, spring 82, spring retainer 84, and spring retainer pin 86. All parts of caged ball adapter 64, except spring 82, are formed using composite or non-metallic material such as, for example, a high performance epoxy resin matrix with reinforced glass fibers.

Caged ball adapter 64 is constructed by placing ball 80 in and on inner diameter ball seat 78, placing spring 82 on top of ball, then placing spring retainer 84 on top of spring 82 and then pinning spring retainer 84 in place with spring retainer pin 86. Spring retainer 84 is doughnut shaped having an opening 85 therein which allows fluid to flow therethrough. Once placed inside housing 72, ball retaining pin 86 is placed inserted through holes 73 in housing 72, across the top of spring retainer 84, thereby preventing retainer 84 from being dislodged. At this point, caged ball adapter 64 is screwed into the threaded connection 32 inside mandrel. Now, caged ball plug 20 (FIG. 3A) can be run and fluid and/or pressure is blocked from above while allowing pressure from below via bore 88. The pressure/flow from below is allowed up bore 88 and around ball 80, through spring 82 and opening 85, and thru the fluid bypass ports 76.

Spring 82 holds ball 80 down on the inner diameter bevel ball seat 78 against a specified force. Spring 82 is of significant strength so that while caged ball plug 20 is moving downward inside the conduit before setting, fluid will bypass around plug 20 rather than bypassing around ball 80. This prevents the fluid from damaging ball seat 78 before the fracing process.

The caged ball adapter 64 also comprises a shoulder 90 which defines a specified larger outer diameter (at the upper end of assembly 64) that provides a stopping point for the connection thread 32 of mandrel 22 and allows the operator to know when assembly 64 is in place. In this embodiment, a wrench may be used to thread adapter 48 into threads 32 of mandrel 22, thereby forcing O-rings 74 into the sealing portion of mandrel 22 and creating the seal. After caged ball plug 20 is set, caged ball adapter 64 is such that fluid/pressure from below is allowed around ball 80 and out the top of adapter and thru the bypass ports 76 of the adapter. As such, the present invention provides a one piece assembly that allows the user to convert the tool easily in field from a solid bridge plug (FIG. 1A) or ball drop plug (FIG. 2) to a caged ball plug or vice versa. In addition, the components of assembly 64 are, with exception of spring 82, of a composite material and thus easier drillable and much preferred over any adapter kits using metal such as brass, aluminum, or steel.

An exemplary embodiment of the present invention provides a slip assembly for use with a downhole tool, the slip assembly comprising: an upper slip carrier made of non-metallic material; a plurality of upper slip inserts coupled to the upper slip carrier, the upper slip carrier and plurality of upper slip inserts forming an upper slip assembly; a lower slip carrier made of non-metallic material; and a plurality of lower slip inserts coupled to the lower slip carrier, the lower slip carrier and the plurality of lower slip inserts forming a lower slip assembly. In another, the upper slip assembly comprises a contact point for a setting tool. In yet another, the assembly further comprises at least one groove extending around an inner surface of the plurality of upper and lower slip inserts; and at least one groove extending around an outer surface of the upper and lower slip carriers, wherein the at least one groove of the upper slip inserts is adapted to mate with the at least one groove of the upper slip carrier, and the at least one groove of the lower slip inserts is adapted to mate with the at least one groove of the lower slip carrier.

An exemplary methodology of the present invention provides a method of manufacturing a slip assembly for use with a downhole tool, the method comprising the steps of: (a) providing an upper slip carrier made of non-metallic material; (b) providing a plurality of upper slip inserts coupled to the upper slip carrier, the upper slip carrier and plurality of upper slip inserts forming an upper slip assembly; (c) providing a lower slip carrier made of non-metallic material; and (d) providing a plurality of lower slip inserts coupled to the lower slip carrier, the lower slip carrier and the plurality of lower slip inserts forming a lower slip assembly. Another methodology further comprises the step of providing the upper slip assembly with a contact point for a setting tool. Yet another methodology further comprises the steps of providing at least one groove extending around an inner surface of the plurality of upper and lower slip inserts; and providing at least one groove extending around an outer surface of the upper and lower slip carriers, wherein the at least one groove of the upper slip inserts is adapted to mate with the at least one groove of the upper slip carrier, and the at least one groove of the lower slip inserts is adapted to mate with the at least one groove of the lower slip carrier.

Another exemplary methodology of the present invention provides a method of using a slip assembly with a downhole tool, the method comprising the steps of: (a) deploying the downhole tool into a wellbore, the downhole tool comprising the slip assembly which comprises: an upper slip carrier made of non-metallic material; a plurality of upper slip inserts coupled to the upper slip carrier, the upper slip carrier and plurality of upper slip inserts forming an upper slip assembly; a lower slip carrier made of non-metallic material; and a plurality of lower slip inserts coupled to the lower slip carrier, the lower slip carrier and the plurality of lower slip inserts forming a lower slip assembly; and (b) gripping a wall of the wellbore using the slip assembly. In another methodology, the upper slip assembly comprises a contact point for a setting tool. In yet another, the slip assembly further comprises: at least one groove extending around an inner surface of the plurality of upper and lower slip inserts; and at least one groove extending around an outer surface of the upper and lower slip carriers, wherein the at least one groove of the upper slip inserts is adapted to mate with the at least one groove of the upper slip carrier, and the at least one groove of the lower slip inserts is adapted to mate with the at least one groove of the lower slip carrier.

Another exemplary embodiment of the present invention provides a slip assembly for use with a downhole tool, the slip assembly comprising: a slip carrier made of non-metallic material; and a plurality of slip inserts coupled to the slip carrier. In another, the slip assembly further comprises a contact point for a setting tool. In yet another, the assembly further comprises at least one groove extending around an inner surface of the plurality of slip inserts; and at least one groove extending around an outer surface of the slip carrier, wherein the at least one groove of the slip inserts is adapted to mate with the at least one groove of the slip carrier.

Another exemplary methodology of the present invention provides a method of manufacturing a slip assembly for use with a downhole tool, the method comprising the steps of: (a) providing a slip carrier made of non-metallic material; and (b) providing a plurality of slip inserts coupled to the slip carrier. In another, the method further comprises the step of providing the slip assembly with a contact point for a setting tool. In another, the method further comprises the steps of providing at least one groove extending around an inner surface of the plurality of slip inserts; and providing at least one groove extending around an outer surface of the slip carrier, wherein the at least one groove of the slip inserts is adapted to mate with the at least one groove of the slip carrier.

Another exemplary methodology of the present invention provides a method of using a slip assembly with a downhole tool, the method comprising the steps of: (a) deploying the downhole tool into a wellbore, the downhole tool comprising the slip assembly comprising: a slip carrier made of non-metallic material; and a plurality of slip inserts coupled to the slip carrier; and (b) gripping a wall of the wellbore using the slip assembly. In another, the method further comprises the step of using a contact point on the slip assembly to set the downhole tool with a setting tool. In another, the slip assembly further comprises: at least one groove extending around an inner surface of the plurality of slip inserts; and at least one groove extending around an outer surface of the slip carrier, wherein the at least one groove of the slip inserts is adapted to mate with the at least one groove of the slip carrier.

Although various embodiments and methodologies have been shown and described, the invention is not limited to such embodiments and methodologies and will be understood to include all modifications and variations as would be apparent to one skilled in the art. Other variations and modifications will be apparent to the skilled person. For example, some components are described herein as being comprised entirely of non-metallic material. However, the ordinarily skilled artisan having the benefit of this disclosure readily appreciates such components could be comprised of a combination of non-metallic and metallic materials without departing from the spirit of the present invention.

Such variations and modifications may involve equivalent and other features which are already known and which may be used instead of, or in addition to, features described herein. Features that are described in the context of separate embodiments may be provided in combination in a single embodiment. Conversely, features which are described in the context of a single embodiment may also be provided separately or in any suitable sub-combination. Therefore, it should be understood that the invention is not intended to be limited to the particular forms disclosed. Rather, the intention is to cover all modifications, equivalents and alternatives falling within the spirit and scope of the invention as defined by the appended claims.

The invention claimed is:

1. A downhole tool for isolating a wellbore, the downhole tool comprising:

a mandrel made of non-metallic material, the mandrel comprising an isolation region at a first end of the mandrel;

a shear sleeve adapter disposable on an outer surface of the isolation region, the shear sleeve adapter having holes aligned with holes in the outer surface of the isolation region;

a slip assembly positioned around an outer surface of the mandrel, wherein the slip assembly has a slip carrier made of a non-metallic material and slip inserts coupled to the slip carrier, wherein the slip inserts form a shoulder in both of a non-extended position and an extended position that comprises a contact point for a setting tool;

a packing element positioned around the outer surface of the mandrel; and a shoe positioned around the outer surface of the mandrel at a second end of the mandrel.

2. The downhole tool of claim 1, wherein the slip assembly comprises:

a first slip assembly disposed about the first end of the mandrel; and a second slip assembly disposed about the second end of the mandrel.

3. The downhole tool of claim 2, wherein the slip assembly further comprises:

a slip stop disposed adjacent to the first slip assembly.

4. The downhole tool of claim 2, further comprising:

a groove extending about an inner surface of each the plurality of slip inserts; and a groove extending about an outer surface of the each slip carriers that is adapted to mate with the groove of one of the slip inserts.

5. The downhole tool of claim 1, wherein the isolation region comprises threads along an inner surface of the isolation region.

6. The downhole tool of claim 1, further comprising a beveled edge along the isolation region.

7. The downhole tool of claim 1, wherein the slip inserts extend radially outward past a diameter of a slip stop coupled to the mandrel.

8. A downhole tool for isolating a wellbore, the downhole tool comprising:

a mandrel made of non-metallic material, the mandrel having a first outer diameter at a first end thereof and a second outer diameter at a second end thereof, the first outer diameter being greater than the second outer diameter and comprising an isolation region;

a slip assembly coupled to the mandrel around the second outer diameter, wherein the slip assembly has a slip carrier made of a made of a non-metallic material and slip inserts coupled to the slip carrier, wherein the slip inserts form a shoulder in both of a non-extended position and an extended position that comprises a contact point for a setting tool;

a packing element coupled to the mandrel around the second outer diameter; and a shoe coupled to a second end of the mandrel along the second outer diameter.

9. The downhole tool of claim 8, wherein the isolation region comprises threads along an inner surface of the isolation region.

10. The downhole tool of claim 8, further comprising a beveled edge along the isolation region.

11. The downhole tool of claim 8, wherein the slip assembly comprises:

a first slip assembly disposed about the first end of the mandrel; and a second slip assembly disposed about the second end of the mandrel.

12. The downhole tool of claim 11, wherein the slip assembly further comprises:

a slip stop disposed adjacent to the first slip assembly.

13. The downhole tool of claim 11, further comprising:

a groove extending about an inner surface of each the plurality of slip inserts; and a groove extending about an outer surface of the each slip carriers that is adapted to mate with the groove of one of the slip inserts.

14. The downhole tool of claim 8, wherein the slip inserts extend radially outward past a diameter of a slip stop coupled to the mandrel.

15. A downhole tool for isolating a wellbore, the downhole tool comprising:

a mandrel made of non-metallic material, the mandrel comprising an isolation region at a first end of the mandrel;

a shear sleeve adapter disposable on an outer surface of the isolation region, the shear sleeve adapter having holes aligned with holes in the outer surface of the isolation region;

a shoe positioned around the outer surface of the mandrel at a second end of the mandrel;

a packing element positioned around the outer surface of the mandrel; and a slip assembly positioned around the outer surface of the mandrel, wherein the slip assembly comprises:

a first slip carrier made of non-metallic material coupled to the mandrel adjacent to the isolation region;

a plurality of first slip inserts coupled to the first slip carrier, the first slip carrier and plurality of first slip inserts forming a first assembly, wherein the first slip inserts of the first slip assembly form a shoulder in both of a non-extended position and an extended position that comprises a contact point for a setting tool; and a second slip carrier made of non-metallic material coupled to the mandrel adjacent to the shoe; and a plurality of second slip inserts coupled to the second slip carrier, the second slip carrier and the plurality of second slip inserts forming a second slip assembly.

16. The downhole tool of claim 15, wherein the isolation region comprises threads along an inner surface of the isolation region.

17. The downhole tool of claim 15, further comprising a beveled edge along the isolation region.

18. The downhole tool of claim 15, wherein the slip inserts extend radially outward past a diameter of a slip stop coupled to the mandrel.

* * * * *